US005201406A

United States Patent [19]

Kellis

[11] Patent Number: 5,201,406

[45] Date of Patent: Apr. 13, 1993

[54] BELT WINDER

[75] Inventor: John K. Kellis, Winfield, Ala.

[73] Assignee: Continental Conveyor & Equipment Co., L.P., Winfield, Ala.

[21] Appl. No.: 868,109

[22] Filed: Apr. 14, 1992

[51] Int. Cl.[5] ..... B65G 21/14

[52] U.S. Cl. ..... 198/812

[58] Field of Search ..... 198/812; 242/86.51, 242/86.52

[56] References Cited

U.S. PATENT DOCUMENTS

| | | | |
|---|---|---|---|
| 2,822,913 | 2/1958 | Craggs et al. | 198/812 |
| 2,846,050 | 8/1958 | Craggs et al. | 198/812 |
| 2,846,051 | 8/1958 | Craggs et al. | 198/812 |
| 2,858,935 | 11/1958 | Presti | 198/812 |
| 2,933,177 | 4/1960 | Long | 198/812 |
| 3,667,586 | 6/1972 | Matthews | 198/812 |
| 3,997,216 | 12/1976 | Russell | 198/812 X |
| 4,195,726 | 4/1980 | Denny et al. | 198/812 |
| 4,208,022 | 6/1980 | Wimberly | 198/812 X |

FOREIGN PATENT DOCUMENTS

| | | | |
|---|---|---|---|
| 1025600 | 6/1983 | U.S.S.R. | 198/812 |
| 0795502 | 5/1958 | United Kingdom | 198/812 |
| 1579472 | 11/1980 | United Kingdom | 198/812 |
| 2070542 | 9/1981 | United Kingdom | 198/812 |

*Primary Examiner*—Robert P. Olszewski
*Assistant Examiner*—James R. Bidwell
*Attorney, Agent, or Firm*—Pearne, Gordon, McCoy & Granger

[57] ABSTRACT

A technique for the insertion and removal of a section of belting in and from an endless belt conveyor is disclosed. The technique includes method and apparatus including a frame which may comprise the frame of the main conveyor or the chassis of a wheeled vehicle. A driven belt pulley is rotatably mounted in the frame and is engageable by an idler pinch roll. A section of belting to be removed from the conveyor is engaged between the pulley and the pinch roll so that substantially all of the belt removing tension is absorbed by the motor driving the belt pulley. The belt may then be wound onto a driven reel at a substantially constant winding torque.

9 Claims, 4 Drawing Sheets

BELT WINDER

BACKGROUND OF THE INVENTION

This invention relates to handling apparatus and, more particularly, to method and apparatus for the insertion and removal of a section of belting in and from an extensible endless belt conveyor.

In long wall coal mining operations two parallel panels or gate entries are driven into the coal seam up to 1000 feet apart. The gate entries are joined by an entry at right angles which forms the long wall face. Successive strips are taken off the side of the face entry and the coal is deposited on a face conveyor which delivers it to a panel conveyor. As the strip is removed from the face, the conveyor is shortened to follow the removal equipment. As the conveyor is shortened, the endless belt is accumulated by a pulley system in the conveyor. To minimize the complexity of belt storage in the conveyor, it is common practice to remove a section of the belt and wind the removed section on a spool so that the belt may be stored and reinserted into the conveyor for a successive mining operation at another seam face.

The conventional manner in which belting sections are removed from the conveyor frame generally involve positioning a spool adjacent the head pulley of the conveyor. The storage reel may be part of a self propelled vehicle. The conveying reach is connected at a belt lacing splice and the section to be removed is wound from the conveyor by the spool which is powered by a hydraulic motor. The belt pull or tension developed and the winding speed are a function of the increasing diameter of the belt roll as the belt is wound on the spool. When the spool is empty, the belt pull or tension is at a maximum while the belt speed is at a minimum. As the diameter of the spool increases, the belt speed increases while the belt pull decreases. Since the belt section being removed from the conveyor is laced through a number of support rolls, a significant amount of pull on the belt is required to wind the belt on the spool. While tensile forces in the belt remain substantially constant during this winding operation, the torque loads on the winding motor are increased as a function of the radius of the material wound on the spool since the progressively increasing extent of the radius constitutes a moment arm with respect to the center of the winding shaft. The torque capacity of the winding motor in prior art devices is a function of the diameter of the wound belting rather than the torque required to merely overcome the resistance to the removal of the belt from the accumulator portion of the conveyor.

Examples of such prior art may be found in U.S. Pat. No. 2,846,051 to Craigs et al. and in U.S. Pat. No. 2,933,177, to Long.

SUMMARY OF THE INVENTION

This invention provides a conveyor belt transfer device for insertion and removal of a section of belting in and from an endless belt conveyor. According to this invention, the transfer device includes a powered pulley which cooperates with a pinch roll so that the powered pulley and the pinch roll exert tensile forces on the belt to remove the belt from the conveyor. The belt extends from the conveyor pulley to a winding spool which is powered by a motor to wind the belt on the pulley. The belt reach between the spool and the pulley is maintained under little or no tension since the belt tension is absorbed by the powering mechanism for the pulley. The motor driving the spool may be operated manually to merely wind the belt issuing from the pulley and the pinch roll, and, of course, its speed as measured in revolutions per minute may be decreased as the size of the wound belting increases, assuming, of course, that the surface speed of the belting is substantially constant. Alternately, the spool winding motor may be controlled automatically by sensing belt tension between the pulley and the spool.

According to this invention, a conveyor belt transfer device for an endless belt conveyor comprises a frame having a drive conveyor pulley rotatably mounted on the frame. The conveyor pulley has a cylindrical surface and is driven by a motor such as a hydraulic motor. The conveyor belt is separated at a belt splice and is wrapped about a portion of the cylindrical surface of the pulley. A pinch roll is provided in a position adjacent the conveyor pulley and is advanced towards said pulley to apply pressure against the portion of the belt wrapped about the pulley. The pinch roll is an idler roll and is driven by contact with the conveyor belt and exerts sufficient pressure on the conveyor belt so that a belt reach beyond a zone of the belt contacted by the pinch roll and the conveyor is under tension which is caused by rotation of the conveyor pulley. The portion of the belt downstream of the pinch roll is under substantially zero tension and that portion of the belt is wound on a spool which is powered by a variable speed drive.

The powered conveyor pulley, its cooperating pinch roll, and the winding spool may all be mounted on a wheeled chassis for transportation to and from the conveyor. The chassis may be provided with conventional floor and ceiling jacks to steady the assembly during winding or unwinding operations.

Alternately, the aforementioned conveyor pulley may itself comprise a powered pulley of the conveyor and the pinch roll and the spool may be mounted on a chassis for transportation to and from the conveyor.

DETAILED DESCRIPTION OF THE INVENTION

Figure 1:
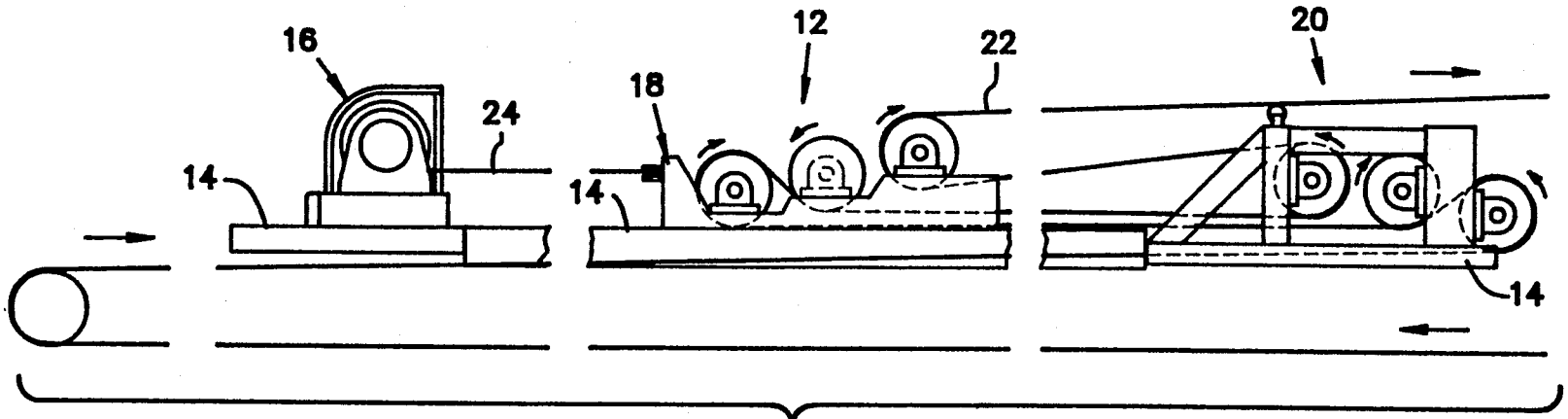
FIG. 1 is a diagrammatic view illustrating the belt storage unit portion of a conveyor.

Referring now to the drawings, and, particularly, to FIGS. 1 through 4, there is illustrated a belt winder 10 according to this invention. The belt winder 10 is adapted to be used in conjunction with a belt storage unit portion 12 of a conveyor belt assembly. The belt storage unit portion 12 is typically used in underground mining operations and, particularly, in operations involving long wall coal mining procedures. Long wall working involves mechanically removing strips of coal from a side of a face entry in the mine and the deposition of the coal on a face conveyor which delivers the coal to a panel conveyor and the shaft. These conveyors may be more than one thousand feet in length and, with respect to the long wall panel conveyor, must be shortened as the mining progresses. Therefore, storage units are provided in the conveyor such as the storage unit 12 illustrated in FIG. 1.

The storage unit 12 is generally positioned near the head section of the conveyor and is intended to store the conveyor belt as the tail section of the assembly is retracted. To this end, there is provided rails 14 which mount a cable winch 16, a movable sled 18 and a stationary rolls assembly 20.

The storage unit 12 may store a significant portion of the total extent of a conveyor belt 22 as a cable 24 associated with the winch 16 moves the sled 18 toward the winch 16. During operation of the conveyor the winch 16 also applies a substantially constant predetermined tension to the belt 22 by a conventional tension control mechanism (not shown). Even though the storage unit 12 is capable of storing a considerable portion of the length of belt 22, it is necessary to physically remove sections of the belt 22 from the conveyor.

To this end, there is provided a belt winder, according to one aspect of this invention which may be positioned adjacent to or inline with the storage unit 12 to remove a length of belt from the conveyor. The belt winder 10 illustrated in FIGS. 2 through 4 comprises a chassis frame 26 which includes side frame members 28 and 30 and an end frame member 32. The side frame members 28 and 30 are provided with ground engaging wheels 34 and the end frame member 32 is provided with a trailer hitch assembly 36. The belt winder is adapted to be positioned adjacent to or inline with the stationary roll assembly 20 and held in place by stab jacks 38 which are pivotally connected to support beams 40 on the frame 26 and which are adapted to be swung toward the mine roof by hydraulic cylinders 42. The frame is also stabilized by a stabilizing foot assembly 44 which is pivoted about a beam 46 by a hydraulic cylinder 48 so that the foot assembly 44 is adapted to engage the mine floor.

When the belt winder 10 is in position adjacent to or inline with the assembly 12, the stab jacks 38 are raised to a vertical position and are extended to engage the roof of the mine and the foot assembly 44 is lowered by the hydraulic cylinder 48 to engage the floor of the mine. With the belt winder 10 thus stabilized, the belt 22 is parted at a transverse splice and is fed into the belt winder 10 by wrapping the belt 22 around a drive conveyor pulley 50, as may be seen most clearly in FIG. 3. The pulley 50 is provided with a rubber surface layer 52 having a tread pattern 54 embossed therein. The pulley 50 is mounted through the stationary flanges of the gear boxes (mounted integral to the pulley) on to the frame 26 and is driven in a counterclockwise direction as viewed in FIG. 3 by a hydraulic motor 56. A pinch roll 60 is mounted parallel to and adjacent to the pulley 50 and is adapted to move toward and away from the pulley 50. To this end, the pinch roll 60 is mounted in bearing blocks 62 which are slidable along upper and lower tracks 64 and 66. Each bearing block 62 is reciprocated by a piston 68 to advance and retract the pinch roll 60 toward and away from the pulley 50 to grip the belt 22 between the pulley 50 and the roll 60.

The end of the belt 22 is wrapped about a winding spool 70 which extends between a pair of side support assemblies 72. The side support assembly 72 pivotally mount a pair of spool support and ejection arm assemblies 74 (FIG. 3) and the arms are pivoted about pivot pins 76. Hydraulic arms 78 are provided for each arm assembly 74 and include a cylinder 80 which is pivoted to a support assembly 72 by a pivot pin 82 and which have piston rods 84 which are pivoted to the arms 74 by pivot pins 86. Each end of the spool 70 is cradled in roller supports 88 provided at the end of each arm assembly 74.

Figure 2:
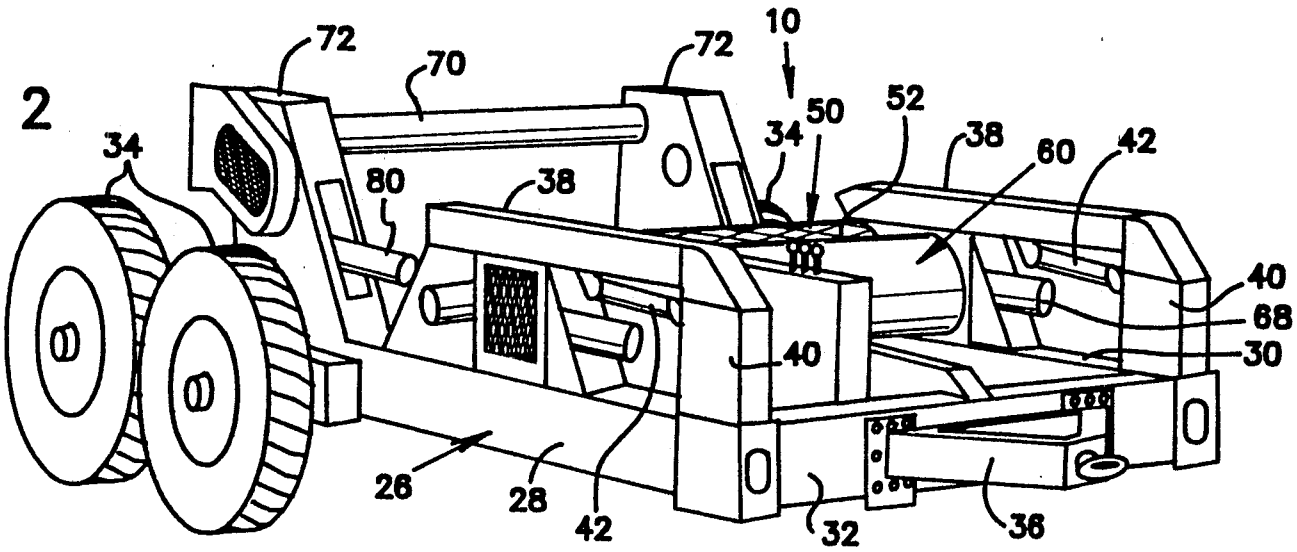
FIG. 2 is a perspective view of a conveyor belt transfer device according to one aspect of this invention.
Figure 4:
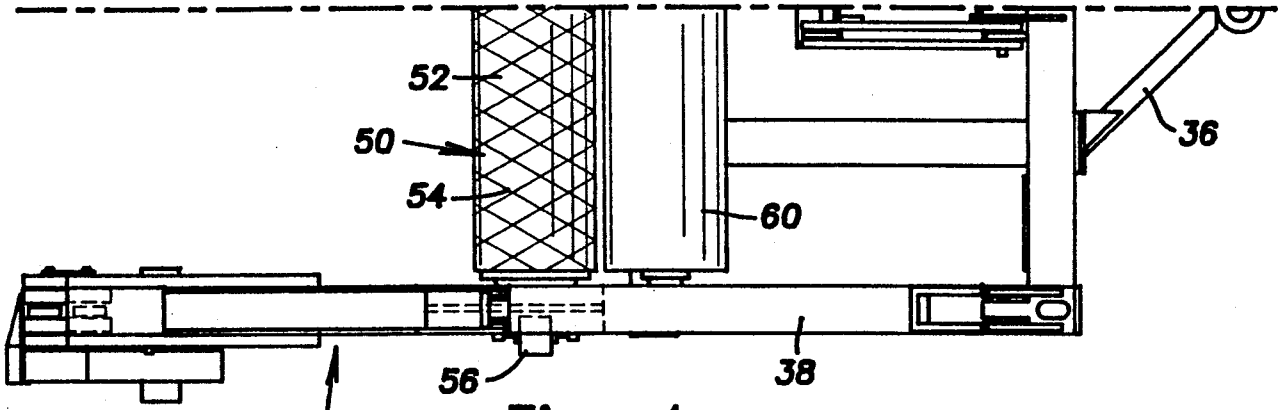
FIG. 4 is a fragmentary plan view of the transfer device illustrated in FIGS. 2 and 3.
Figure 3:
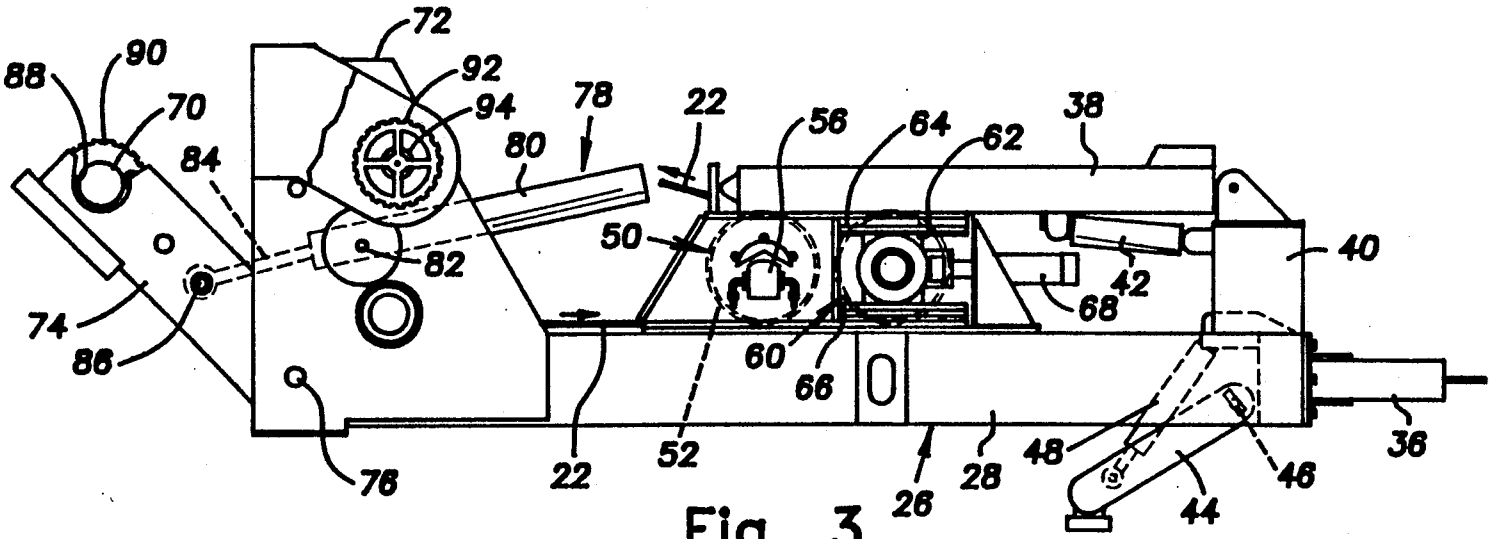
FIG. 3 is an elevational view of the transfer device illustrated in FIG. 2.

A gear 90 is fixed to one end of the spool 70 and, when the arm assembly 74 is in its raised position illustrated in FIGS. 2 and 4, the gear 90 meshes with a drive gear 92 which is driven by a hydraulic motor 94. Thus, the belt 22 may be wrapped about the spool 70 when the arm assemblies 74 are in their raised or retracted position illustrated in FIGS. 2 and 4.

The belt 22 is drawn from the storage unit 12 by being pinched between the pulley 50 and the pinch roll 60. The cylinders 68 exert a sufficient pressure on the pinch roll 60 to exert pressure against that portion of the conveyor belt 22 which is wrapped about a portion of the pulley 50. That portion of the belt 22 between the pulley 50 and the pinch roll 60 to the storage unit 12 is under tension and the pulley 50 is driven by its motor 56 to exert a substantially constant torque on the pulley 60 which is sufficient to overcome the back tension exerted by the belt 22. That portion of the belt 22 extending from the pulley 50 and the pinch roll 60 to the spool 70 is under substantially zero tension and, therefore, the winding torque exerted by the motor 94 is substantially constant regardless of the radius of the belt 22 wound thereon. The hydraulic motor 56, therefore, may be selected to exert a torque necessary to overcome the back tension in the belt 22 through the conveyor 12 while the motor 94 may be selected to perform its winding function under substantially zero belt tension. Neither motor 56 or 94 must have a rated capacity which is dependant upon a moment arm resulting from the wound radius of the belt 22 on the spool 70.

Figure 5:
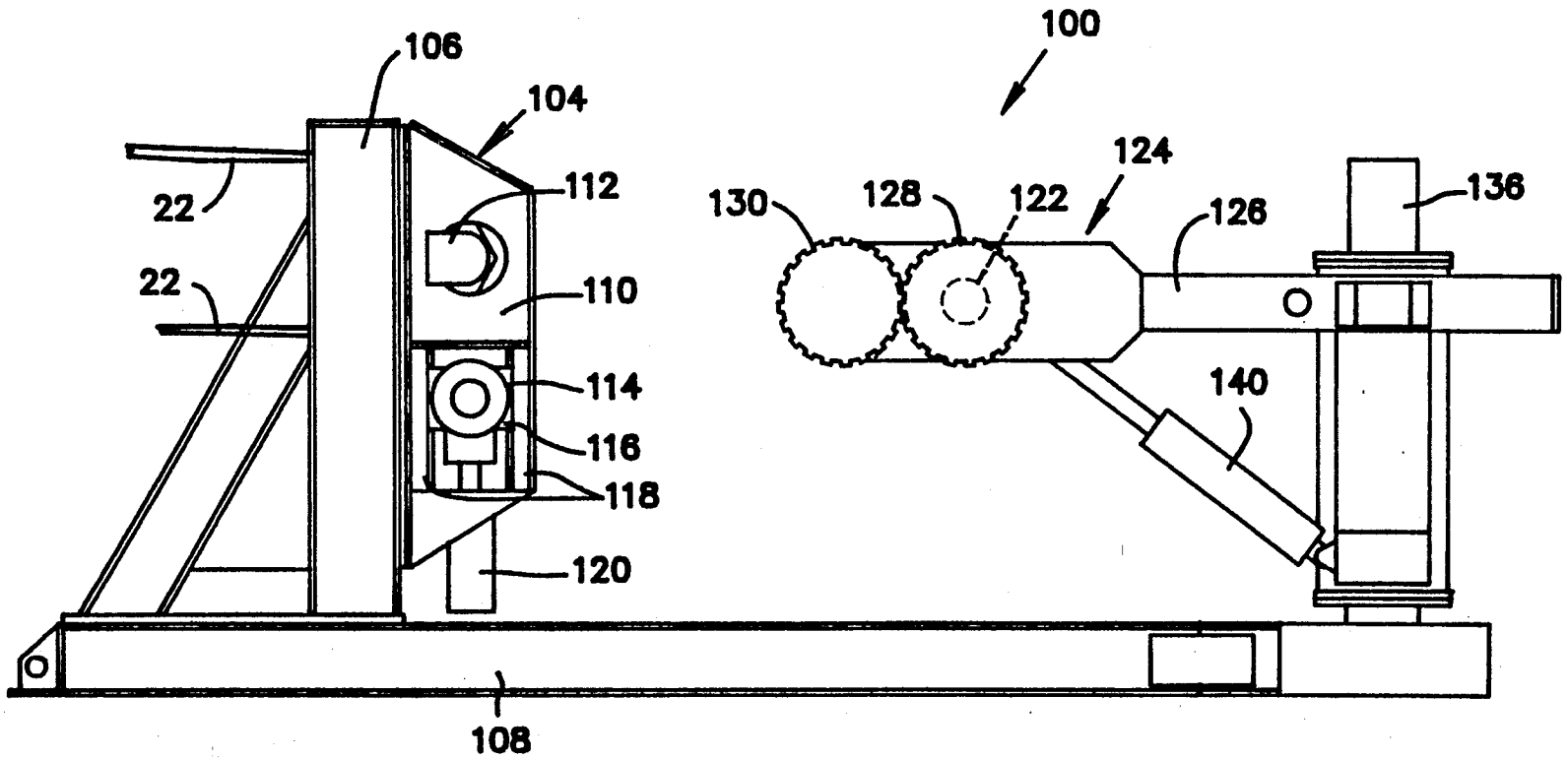
FIG. 5 is an elevational view of a transfer device according to a further aspect of this invention.
Figure 6:
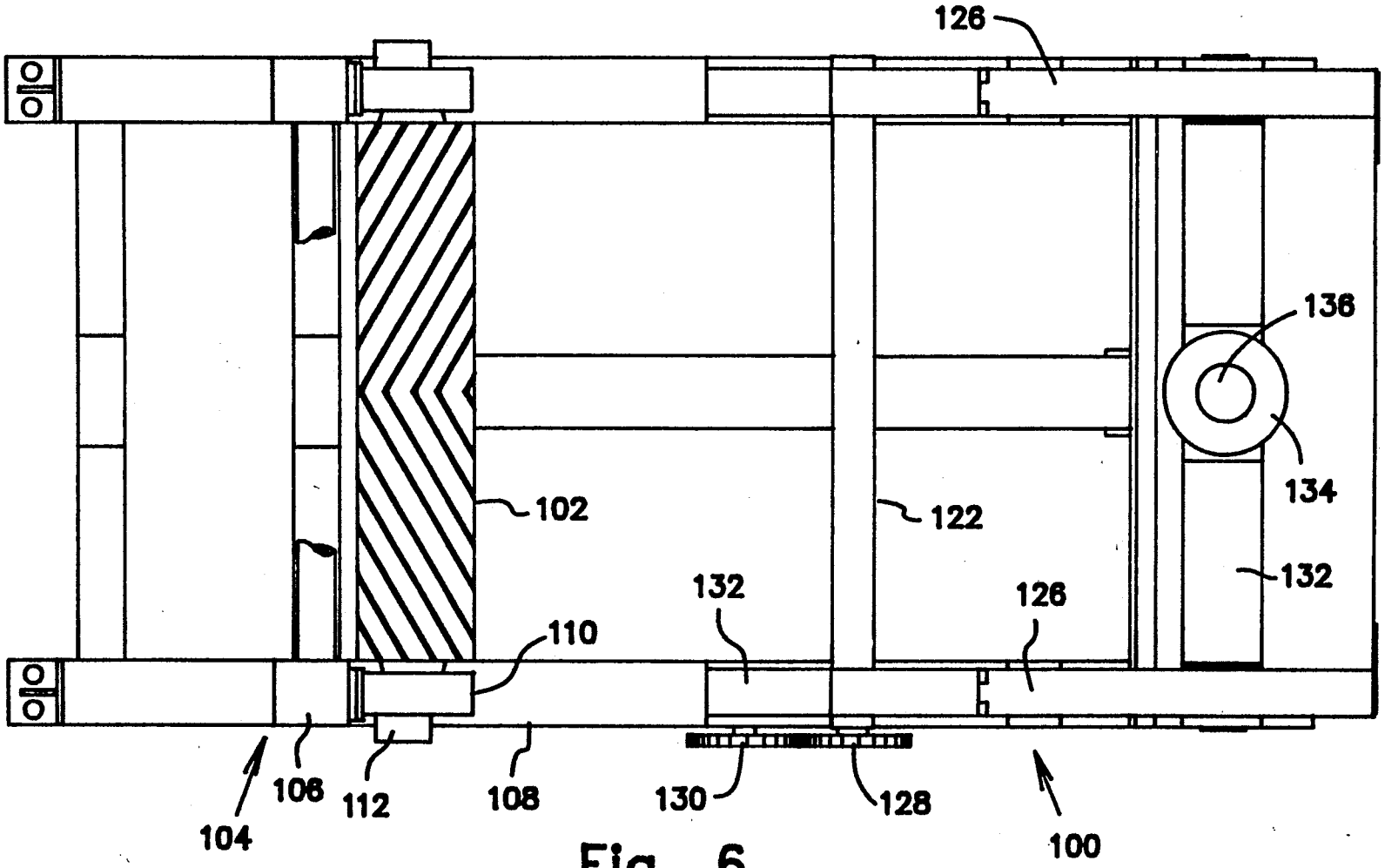
FIG. 6 is a plan view of the transfer device illustrated in FIG. 5.

Referring now to FIGS. 5 and 6, there is illustrated a belt winder 100 according to a further aspect of this invention. The belt winder 100 is adapted to be associated with the main conveyor which includes the storage unit 12. The belt winder 100 is located at the head or tail end of the conveyor and is associated with an end pulley 102 of the winder and associated with a drive support assembly 104 which includes side support members 106, support beams 108, and pulley support members 110. The pulley 102 is mounted for rotation between the support members 110 and is driven by a hydraulic motor 112. An idler pinch roll 114 is located adjacent the conveyor pulley 104 and is supported by guide blocks 116 which are slidable along tracks 118 in the support 110.

To remove a section of the belt 22, a portion of the upper reach of the belt is parted and the pinch roll 114 is driven against a portion of the belt 22 wrapped about the pulley 104 by energizing an hydraulic cylinder 120. The parted portion of the belt 22 is then wrapped about a reel 122 mounted on a lift arm assembly 124. The reel 122 is rotatably mounted in bearings between carrier arms 126 and has a spur gear 128 at one end thereof which meshes with a driving gear 130 associated with an hydraulic motor 132.

The drive motor 112 absorbs and overcomes all of the back tension on the belt 22 with the pinch roll 114 exerting pressure on the belt 22. The reel 122 need only be powered sufficiently to wind the belt 22 thereon at a speed substantially determined by the speed of the pulley 102. The reel, when wound with the belt 22, may be swung, for example, 90° to deposit the belt on a lift truck. To this end, the support arms 126 are mounted on a pinion assembly which includes a cross beam 132 which connects the arms 126 and which is fixed to a rotatable bearing sleeve 134 pivotally mounted on a support post 136. The arms 126 are supported by pistons 140 which also serve to retract the arms 126 and the reel 122 to clear the roll 102.

What is claimed is:

1. A conveyor belt transfer device for insertion and removal of a section of belting in and from an endless belt conveyor comprising frame means, drive conveyor pulley means rotatably mounted on said frame means and having a belt driving cylindrical surface, drive means for said drive conveyor pulley means, conveyor belt means having a separated end portion extending form a belt storage unit portion of said endless belt conveyor and being wrapped about a portion of said surface, pinch roll means adjacent said conveyor pulley means, means to advance said pinch roll means to exert pressure against a portion of said conveyor belt means wrapped about a portion of said surface, said pinch roll means being rotatably driven by contact with said portion of said conveyor belt means and exerting sufficient pressure on said portion of said conveyor belt means so that a belt reach between a zone of said belt means contacted by said pinch roll means and said storage unit portion is under tension caused by rotation of said conveyor pulley means while a portion of said belt means from said zone to a separated end of said belt means is free of such tension, spool means mounted on said frame and engaging said belt for winding said belt means in a coil, and variable speed drive means for said spool means.

2. A conveyor belt transfer device according to claim 1, wherein said drive conveyor pulley means is a head pulley of said endless belt conveyor.

3. A conveyor belt transfer device according to claim 2, wherein said pinch roll means is mounted in a bearing block, wherein said bearing block is slidable in track means, and wherein said means to advance said pinch roll means comprises a piston and cylinder.

4. A conveyor belt transfer device according to claim 3, wherein said track means guides said bearing block in a vertical direction toward said head pulley.

5. A conveyor belt transfer device according to claim 1, wherein said frame means includes a chassis frame of a wheeled vehicle.

6. A conveyor belt transfer device according to claim 5, wherein said pinch roll means is mounted in a bearing block, wherein said bearing block is slidable in track means, and wherein said means to advance said pinch roll means comprises a piston and cylinder.

7. A conveyor belt transfer device according to claim 6, wherein said track means guides said bearing block in a horizontal direction toward said pulley means.

8. A conveyor belt transfer device according to claim 7, including means to stabilize said frame in a mine tunnel, said means to stabilize including stab jacks associated with said frame means and adapted to engage a mine roof, and stabilizing feet associated with said frame means and adapted to engage a mine floor.

9. A method of removing a section of belting from an adjustable endless belt conveyor comprising the steps of separating the length of belting from a continuous length of belting trained through said conveyor, pinching said length of belting between a pair of rolls, driving at least one of said rolls at a substantially constant speed and applying a substantially constant tension to the belting upstream of said rolls, and winding said belting downstream of said pinch rolls on a storage spool at a substantially uniform belt surface speed and at substantially zero tension.

* * * * *